United States Patent [19]

Stackhouse

[11] 3,955,388

[45] May 11, 1976

[54] COMBINATION MAGNETIC KEY

[75] Inventor: Wells F. Stackhouse, Ashville, N.Y.

[73] Assignee: American Locker Company, Jamestown, N.Y.

[22] Filed: June 9, 1975

[21] Appl. No.: 585,233

[52] U.S. Cl. ..... 70/411; 70/413

[51] Int. Cl.[2] ..... E05B 19/18

[58] Field of Search ..... 70/411, 413, 276; 335/205, 206, 207; 317/134

[56] References Cited

UNITED STATES PATENTS

| | | | |
|---|---|---|---|
| 3,411,046 | 11/1968 | Swannick | 317/134 |
| 3,506,939 | 4/1970 | Hesser | 335/20 C |
| 3,686,659 | 8/1972 | Bostrom | 70/277 X |
| 3,760,312 | 9/1973 | Shlesinger | 335/205 |
| 3,793,565 | 2/1974 | Smith | 317/134 |
| 3,873,092 | 3/1975 | Dettling | 70/27 C X |

*Primary Examiner*—Robert L. Wolfe

*Attorney, Agent, or Firm*—Bean & Bean

[57] ABSTRACT

A key for a magnetic lock is provided with a plurality of dials, which are manually rotatable to position magnet devices carried thereby in desired combination setting positions determined by visual observation of dial carried indicia.

9 Claims, 5 Drawing Figures

COMBINATION MAGNETIC KEY

SUMMARY OF THE INVENTION

The present invention relates to improvements in keys for magnetic locks and more particularly to a key whose magnet devices may be selectively set in a large number of combination setting positions to accommodate the key for use with a plurality of locks having differing combinations, which may, if desired, be changed by suitable internal adjustments of the individual locks.

The present key construction is particularly adapted for use as a "master" key permitting a custodian to employ a single key in operating a plurality of locks having different magnetic combinations, such as might be employed to protect the "cash boxes" of a series of parking meters or to afford security for a plurality of doors used in plants, offices, homes, vehicles or the like.

The key of the present invention is characterized as having a body portion or casing configured to accurately positionally locate the key relative to a reference surface of a lock to be operated. The casing is also formed with a plurality of cavities, which serve to partially accommodate a plurality of rotatably supported combination setting dials. Each dial carries an imbedded magnet device and surface indicia, such as numerals, which have a predetermined positional relationship relative to the magnet device. The casing is preferably formed with view openings to permit observation of the indicia carried by the dials and thus facilitate positioning of the dials in desired combination setting positions.

The key of the present invention is particularly adapted for use with magnetic locks of the type employing magnetically attractable tumbler devices, such as pivotally supported tumbler pins, of the general type disclosed for example by my co-pending patent application entitled MAGNETIC LOCK, filed on or about May 14, 1975; and U.S. Pat. Nos. 3,056,276 and 3,657,907.

DRAWINGS

The nature and mode of operation of the present invention will now be more fully described in the following detailed description taken with the accompanying drawings wherein.

DETAILED DESCRIPTION

Figure 1:
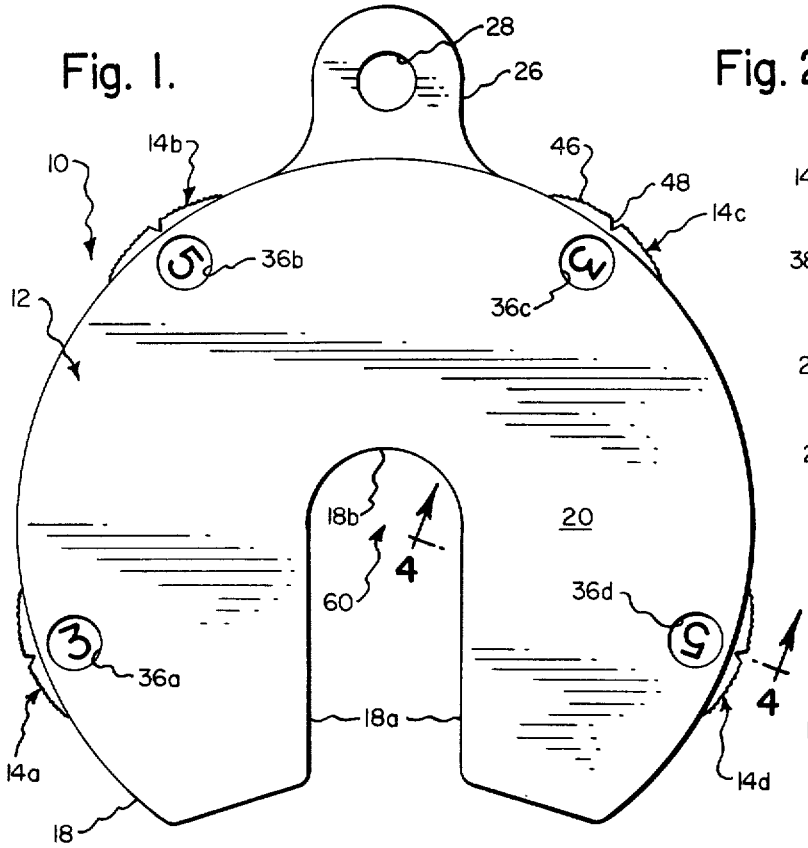
FIG. 1 is a front elevational view of a key formed in accordance with the present invention.
Figure 2:
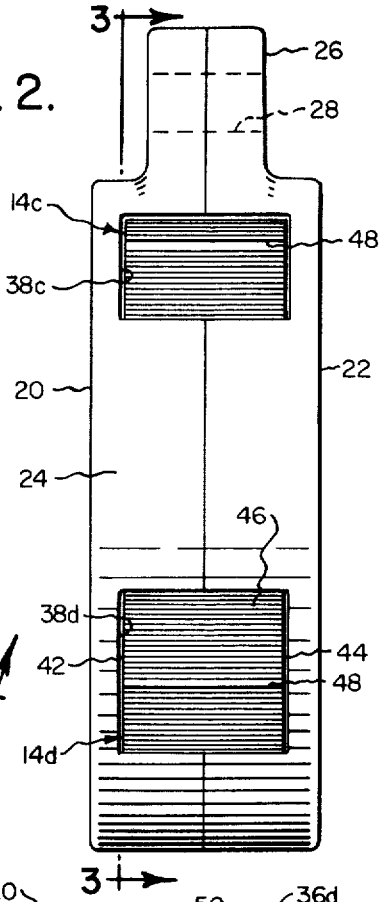
FIG. 2 is a side elevational view thereof.
Figure 3:
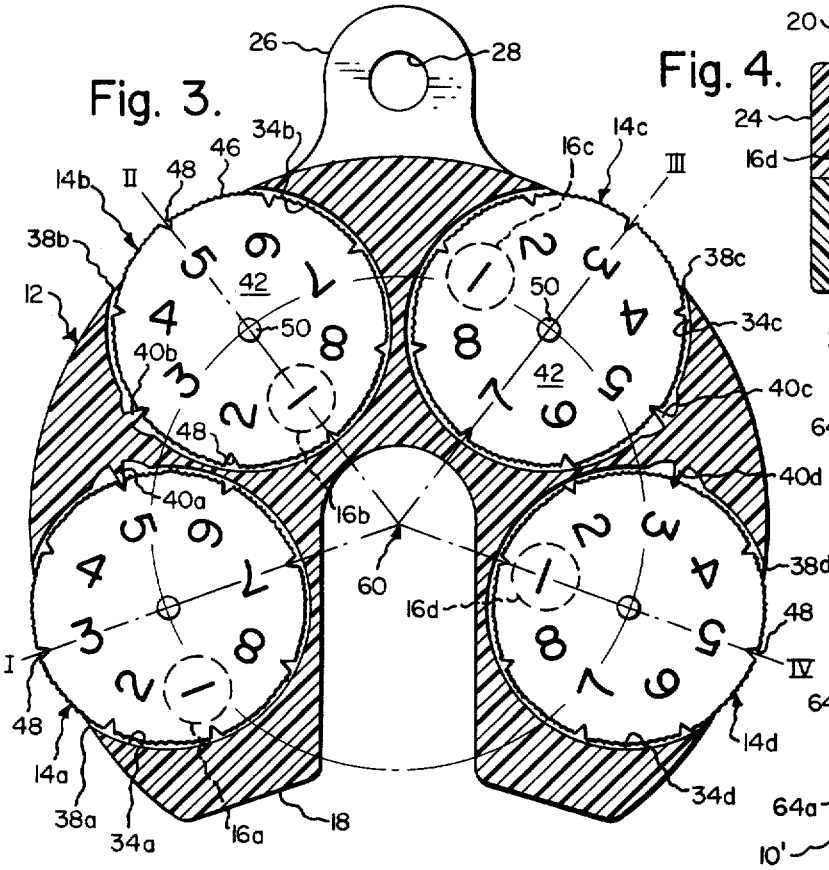
FIG. 3 is a sectional view taken generally along the line 3—3 in FIG. 2.
Figure 4:
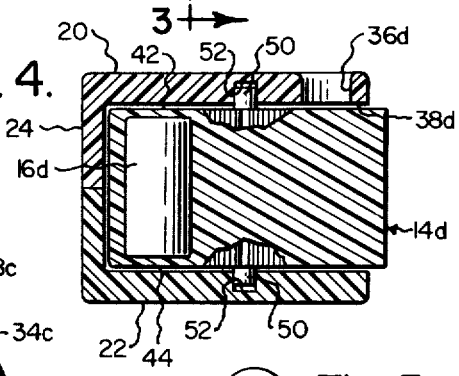
FIG. 4 is a sectional view taken generally along the line 4—4 in FIG. 1.

A key formed in accordance with the present invention is generally designated as 10 in FIGS. 1–3. Key 10 includes a casing 12, which serves to house a plurality of combination setting dials, such as those designated as 14*a*–14*d*. As will be more completely hereinafter described, dials 14*a*–14*d* may be individually manipulated by a user of the key to selectively position dial imbedded permanent magnet devices 16*a*–16*d* in desired combination setting positions. Aside from magnet devices 16*a*–16*d*, the whole of key 10 is preferably formed of a suitable non-magnetic material, ie. a plastic or a metal such as aluminum.

More specifically, casing 12 includes a main body portion 18, which is bounded by generally parallel and planar front or viewing and rear or application surfaces 20 and 22, respectively, and a connecting side surface 24; and an extension portion 26 having an "eye" opening 28 or other suitable means facilitating attachment of key 10 to a key ring or the like.

Preferably, main body portion 18 is of a distinctive non-circular configuration in order to facilitate accurate location of key rear wall 22 with respect to the surface of a lock, not shown, with which the key is to be employed. In this connection, it will be understood that magnetic locks of the type designed to be operated by a magnetic key are conventionally provided with a key receiving and locating contoured surface, such as may be defined by a recess, which cooperates with the side and rear surfaces of a key for the purpose of accurately positioning its fixed position permanent magnet devices relative to magnetically attractable tumbler devices, such as tumbler pins of the lock, which are arranged in operative alignment with the key receiving recess. A body portion of non-symmetrical design, such as that illustrated in FIG. 1, is preferred, since it permits key 10 to be accurately positioned in association with a like configured locating recess of the lock without the need for providing additional indicia on the key and the lock, as would be the case if the key and locating recess were of square, rectangular or other configuration permitting several possible orientations of the key relative to its receiving recess.

In FIGS. 1–4, main body portion 18 is shown as being formed with four generally cylindrically shaped cavities 34*a*–34*d*, which communicate with front wall 20 through dial view openings 36*a*–36*d* and with side wall 24 through dial access openings 38*a*–38*d*. In a preferred form of the invention, main body portion 18 is of a molded plastic construction, whereby to permit resiliently deformable locking tabs or fingers 40*a*–40*d* to be formed integrally with the main body portion and project into cavities 34*a*–34*d* for engagement with dials 14*a*–14*d*, as shown in FIG. 3. Alternatively, locking tabs 40*a*–40*d* may be separately formed of plastic or metal spring material. For convenience of manufacture, body portion 18 may be formed in halves, as indicated by FIG. 2, which may be suitably joined together by adhesive or thermal techniques, after insertion of dials 14*a*–14*d* within cavities 34*a*–34*d*.

Dials 14*a*–14*d* are of generally disc-shaped construction having essentially parallel front and rear surfaces 42 and 44, respectively; and an annular rim or side surface 46, which is formed with peripherally spaced positioning notches 48 and roughened or serrated intermediate such notches to facilitate manipulation thereof by a user. As will be apparent from viewing FIG. 3, front surface 42 of each of dials 14*a*–14*d* is provided with indicia, such as numerals 1–8 arranged in an equally spaced relationship annularly of the front surface and in radial alignment with notches 48. In that dials 14*a*–14*d* are preferably of identical construction, their associated magnet devices 16*a*–16*d* would be arranged in axial alignment with one of the numerals, such as numeral 1, as indicated in FIG. 3. In the preferred construction, main body portion 18 is of a generally "horseshoe" shaped design and dials 14i a–14*d* are supported for rotation about parallel axes arranged essentially normal to main body portion surfaces 20 and 22. Support for the dials may be afforded by providing the dials with a pair of integrally formed bearing pins 50, which are disposed in axial alignment and extend in opposite directions from adjacent the centers of dial surfaces 42 and 44 for receipt within bearing openings 52 arranged in communication with cavities 34*a*–34*d*. Of course, this construction may be reversed such that the bearing pins are formed integrally with the halves of the main body portion.

By again referring to FIG. 3, it will be understood that the axes of rotation of dials 14*a*–14*d* are parallel and pass through the intersections of a circle, whose center is designated 60 and shown as being arranged between the "legs" 18*a* of the body portion adjacent the "base" or "connecting" part thereof, and lines designated by numerals I, II, III and IV, which extend radially from center 60. The angular spacing between lines I–II, II–III and III–IV is preferably equal to about 72° with the angular spacing between lines IV–I being equal to about 144°. This specific arrangement accommodates key 10 for use with the magnetic lock disclosed in my co-pending patent application entitled MAGNETIC LOCK, filed on or about May 14, 1975, whose disclosure is incorporated herein by specific reference.

By the foregoing construction, dials 14*a*–14*d* are supported for rotation within cavities 34*a*–34*d*, while partially projecting outwardly of such cavities through side wall openings 38*a*–38*d* in order to permit such dials to be manually rotated by an operator as required to place magnet devices 16*a*–16*d* in "predetermined combination setting" positions established by the "predetermined combination setting" positions of the tumbler pins of the lock with which key 10 is to be associated; the placement of the magnet devices being of course correlated with the numeral indicia viewable through openings 36*a*–36*d*. As will be apparent, locking tabs 40*a*–40*d* resiliently deform during manual rotations of dials 14*a*–14*d*, but are subsequently received within notches 48 for the purpose of releasably latching the dials in each of the "possible combination setting" positions of the magnet devices, which are shown as by way of illustration in the drawings as being eight in number. The construction may be readily altered as for instance by omitting viewing openings 36*a*–36*d* and placing the numerical indicia on rim surface 46, or by omitting access openings 38*a*–38*d* and enlarging view openings 36*a*–36*d* to afford access for manipulating dials 14*a*–14*d*.

Figure 5:
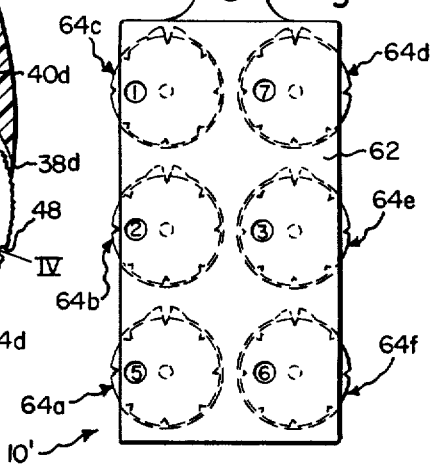
FIG. 5 is a front elevational view of a key of the present invention illustrating an alternative design.

FIG. 5 illustrates an alternative form of the present invention characterized in that body portion 62 of key 10′ is generally rectangular construction and the dials 64*a*–64*f* are arranged in one or more rows extending lengthwise of the body portion. This construction accommodates key 10′ for use with magnetic lock constructions of the general type disclosed by U.S. Pat. Nos. 3,056,276 and 3,657,907, or one of the alternative forms of the invention disclosed in my above mentioned co-pending application, wherein tumbler pins are arranged in rows and are disposed in operative alignment with a generally rectangular key receiving-positioning recess. The structure of key 10′ may be otherwise identical to that described with reference to key 10 in FIGS. 1–4.

I claim:

1. An adjustable combination key for use with magnetic locks of the general type having magnetically attractable tumbler devices and a contoured surface of a given configuration for positionally locating the key relative to said tumbler devices, which key comprises:

a key body portion formed of a non-magnetic material and having front and rear surfaces connected by a side surface, said front, rear and side surfaces being shaped to define a body portion configuration corresponding to said given configuration whereby to permit said rear surface to be positionally located by said contoured surface, said body portion having a plurality of internal cavities and access openings extending between said cavities and one of said surfaces;

a plurality of combination setting dials formed of a non-magnetic material, each of said dials being supported within one of said cavities for rotation through a plurality of combination setting positions about an axis extending essentially normal to said rear surface, each of said dials bearing indicia indicative of said combination setting positions thereof, said access openings affording access to said dials for permitting manual rotation thereof by an operator of said key;

a plurality of magnet devices imbedded one within each of said dials in a radially spaced relationship relative to said axis of its associated dial whereby each of said magnet devices is caused to move about a circular path, as its associated dial is rotated through said combination setting positions thereof; and means for releasably retaining each of said dials in successive ones of said combination setting positions thereof.

2. A key according to claim 1, wherein a view opening extends between each of said cavities and said front surface to permit viewing of said indicia, said access openings extend between said cavities an said side surface, and said dials project from said cavities outwardly through said access openings.

3. A key according to claim 1, wherein said retaining means comprises a plurality of notches spaced annularly of each of said dials and resiliently deformable means carried by said body portion to project into said cavities for receipt within successive ones of said notches as said dial is rotated.

4. A key according to claim 3, wherein said deformable means is formed integrally with said body portion.

5. A key according to claim 1, wherein each of said dials is supported for rotation about its axis by a pair of axially aligned bearing pins carried on one of said dials and said body portion and a pair of bearing pin receiving recesses defined by the other of said dials and said body portion, said access openings extend between said cavities and said side surface, and said dials project from said cavities outwardly through said access openings.

6. A key according to claim 1, wherein said body portion is of a generally horseshoe shaped configuration when said front or rear surfaces are viewed in plan whereby said body portion is characterized as having a pair of leg portions and a connecting portion, the axes of rotation of said dials being parallel and passing through points of intersection of a circle whose center lies between said leg portions adjacent the juncture thereof with said connecting portion and lines extending radially from said center, the spacing between said points of intersection in a direction extending from one of said leg portions into said connecting portion and into said other of said leg portions being essentially equal.

7. A key according to claim 6, wherein said access openings extend between said cavities and said side surface, said dials project from said cavities outwardly through said access openings, a view opening extends between each of said cavities and said front surface to permit viewing of said indicia, said retaining means comprises a plurality of notches spaced annularly of each of said dials and resiliently deformable means carried by said body portion to project into said cavities for receipt within successive ones of said notches as said dial is rotated, and each of said dials is supported for rotation about its axis by a pair of axially aligned bearing pins carried on one of said dials and said body portion and a pair of bearing pin receiving recesses defined by the other of said dials and said body portion.

8. A key according to claim 1, wherein said body portion is essentially of rectangular configuration when said front and rear surfaces are viewed in plan and said dials are arranged within at least one row of dials extending lengthwise of said body portion.

9. A key according to claim 8, wherein said access openings extend between said cavities and said side surface, said dials project from said cavities outwardly through said access openings, and each of said cavities communicates with said front surface via a view opening through which said indicia carried on each said dial may be viewed by an operator of said key.

* * * * *